United States Patent [19]

Quaas

[11] 4,151,736

[45] May 1, 1979

[54] QUICK-CHANGE APPARATUS FOR HEAVY DIE SETS

[75] Inventor: Dietmar G. Quaas, Arlington Heights, Ill.

[73] Assignee: Buhrke Industries, Inc., Arlington Heights, Ill.

[21] Appl. No.: 892,982

[22] Filed: Apr. 3, 1978

[51] Int. Cl.[2] ..... B21J 13/02

[52] U.S. Cl. ..... 72/446; 72/448; 72/462

[58] Field of Search ..... 72/446, 447, 448, 462, 72/349; 100/DIG. 18; 83/698

[56] References Cited

U.S. PATENT DOCUMENTS

| | | | |
|---|---|---|---|
| 3,125,917 | 3/1964 | Smeets | 83/698 |
| 3,422,660 | 1/1969 | Countess | 100/DIG. 18 |
| 3,422,662 | 1/1969 | Geuss | 72/448 |
| 3,461,794 | 8/1969 | Schaeffer | 72/446 |
| 3,742,797 | 7/1973 | Vecchi | 83/698 |
| 3,782,166 | 1/1974 | Whistler | 83/698 |

*Primary Examiner*—C. W. Lanham
*Assistant Examiner*—Gene P. Crosby
*Attorney, Agent, or Firm*—Rummler & Snow

[57] ABSTRACT

An apparatus for quick changing of tooling in heavy die sets is disclosed wherein interchangeable die shoes and tooling are piloted and guided on the bed of the press during operation of the same. Oil-hydraulic jacks lift the die shoe from the bed of the press and disengage the pilots and pneumatic cylinders disengage and retract the guides therefrom for roll-on and roll-off of the shoe from the press giving free access to the die shoe and to the underside of the blanking punch holder plate for repair or change of tooling. Guide sleeves for alignment of the blanking punch with the blanking die during operation of the press are pneumatically disengaged from leader pins in the die shoe providing transfer clearance for the roll-on/roll-off.

9 Claims, 6 Drawing Figures

QUICK-CHANGE APPARATUS FOR HEAVY DIE SETS

BACKGROUND OF THE INVENTION

The art of cupping requires heavy die sets and a large press. Die sets of the triple action type include the usual components, such as blanking and draw punches and die blocks and stripper plates, and all those details disposed on a die shoe and a blanking punch holder plate in a double-acting press above and below a movable sheet of metal stock.

Several problems have been encountered with multiple cupping tooling presently in use. The tooling of each die set therein must be aligned precisely to meet close tolerances required, and consequently the punches and die blocks of each die set must be rigidly retained within their respective holder plate and die shoe by bolting the die blocks directly to their corresponding backup members. As a result, wrench clearances used to install bolts and nuts in the assembly of die sets, in general, present difficult access situations for tooling changes, which multiple die cupping only compounds because of the necessity of close nesting of multiple die sets to conserve sheet stock material.

Another problem that results with multiple cupping tooling is that the die blocks, including the die shoes, are very heavy and each must be completely dismantled and separately removed from the press every time there is need for repair or replacement. This creates considerable down time, on the order of one and a half to two hours, because extra care must be taken in fastening the parts together in precise alignment. As a result, valuable production time is wasted.

SUMMARY OF THE INVENTION

The gist of this invention lies in an apparatus for quick change of multiple die set tooling on double-acting presses. In general, each press has a bed, an outer slide supporting a blanking punch holder plate and an inner slide supporting a draw ram adapter plate. The invention provides for an interchangeable die shoe having means for its roll-off and roll-on transfer from the bed of the press for ready access to its tooling. The blanking punch holder plate, which remains essentially part of the press in this invention, is also rendered readily accessible to changing or repair of tooling by the transfer of the die shoe. Wrench clearance for removal and installation of tooling on the blanking punch holder plate is made available by the die shoe when it is transferred off the press.

In this invention, the die shoe with its stripper plate and blanking and draw dies mounted thereon is lifted from a working position on the bed of the press by oil-hydraulic means for the roll-off transfer. Position-coordinating means, which were engaged to pilot the die shoe on the bed of the press during operation, disengage under lift action of the oil-hydraulic means so there is no interference with the transfer of the die shoe. Guide means, which maintained working alignment of the punch and die blocks during operation of the press, disengage by retraction into the blanking punch holder plate under the action of pneumatic means so again there is no interference with the die shoe during transfer out of the press. Roll-on transfers the die shoe back to working location on the press bed after the tooling has been corrected and the oil-hydraulic means then lowers the die shoe in place.

More specifically, the position-coordinating means of this invention comprises a lift-disengageable piloting means and a retract-disengageable guide means. As shown, the piloting means comprises pilot bushings having female conical seats on their bottom ends which flange-mount in bores in the die shoe and engage male conical pilots which mount in specific location on the top surface of the press bed.

The guide means comprises cylindrical leader pins which are shrunk-fit in bores in the pilot bushings and extend their lead ends above the top surface of the die shoe. Cylindrical sleeves mount in and depend from enlarged bores in the blanking punch holder plate above to engage the lead ends of said pins below for reciprocal movement thereon. Cylindrical guide bushings fixedly mount in the enlarged bores in the blanking punch holder plate in concentric and axially-movable relation with the sleeves. Linear ball bearings insert between the mounting ends of said sleeves and the guide bushings to provide the relative slidability between the same.

The roll-off/roll-on means comprises hardened steel rollers which axle-mount and depend from the die shoe to engage and roll steel tracks provided in the bed of the press. Pads are operationally connected to the rod ends of oil-hydraulic jacks to lift the rollers and their supported die shoe off the bed of the press, to disengage the mating surfaces of the piloting means mounted between the bed of the press and the blanking punch holder plate and to engage the rollers of the roll-on/roll-off means for raising them to the level of engagement with the tracks. Pneumatic air cylinders retract the guide sleeves into the blanking punch holder plate during a tooling change providing clearance for the roll-on/roll-off.

DESCRIPTION OF THE PREFERRED EMBODIMENT

Figure 1:
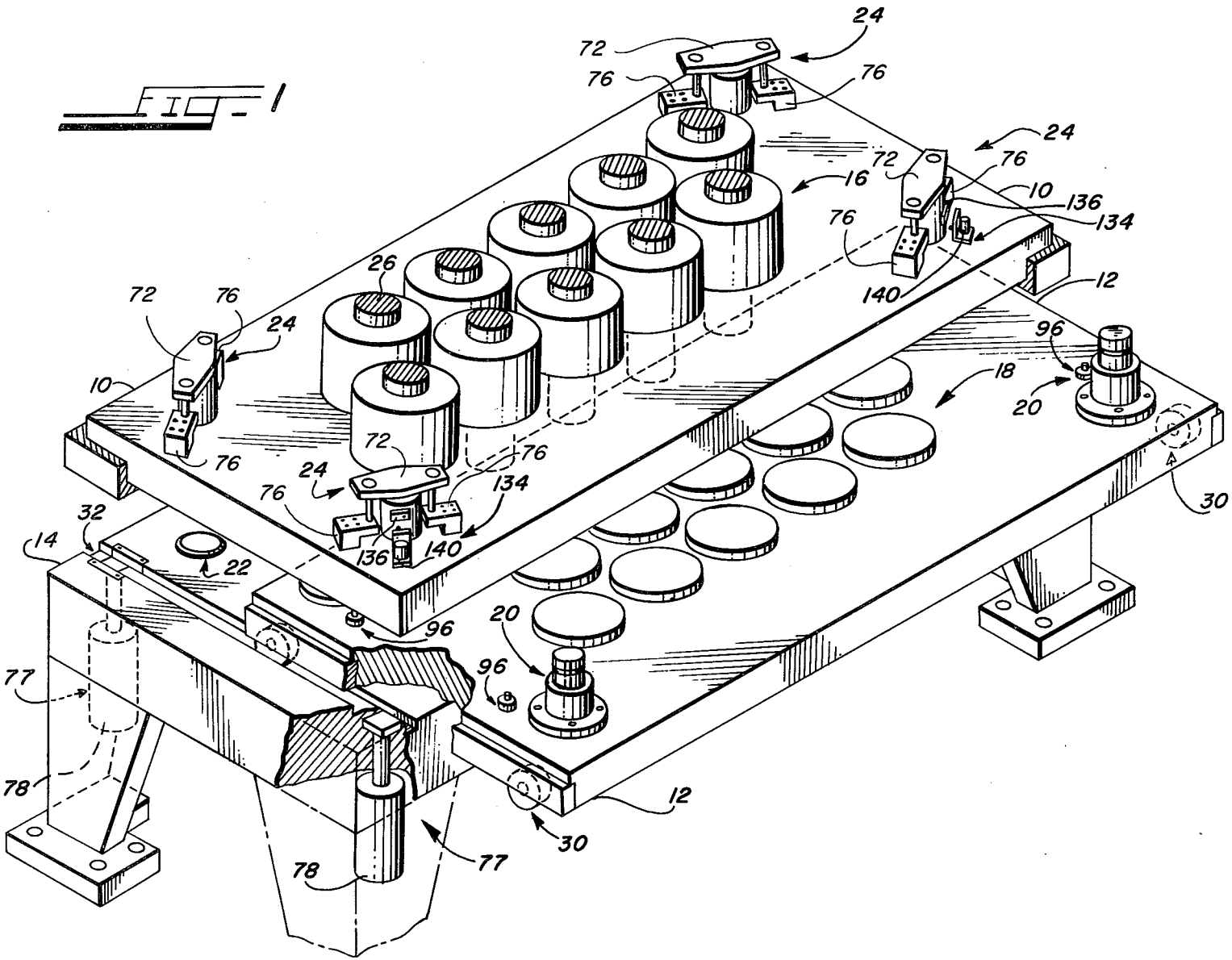
FIG. 1 is a fragmented perspective view of the apparatus of this invention for quick change of heavy die sets.

Referring now to the drawings, and in particular to FIG. 1, a portion of a double-acting press is shown having a bed and outer and inner slides for multiple-forming of cups in accordance with the present invention. Portions of the forming press which are not illustrated, such as the ram, crankshaft and the outer and inner slides, may be of any conventional configuration, and do not form part of the present invention. A blanking punch holder plate 10 mounts on the outer slide and a draw ram adapter plate (not shown) mounts on the inner slide of the press.

Figure 2:
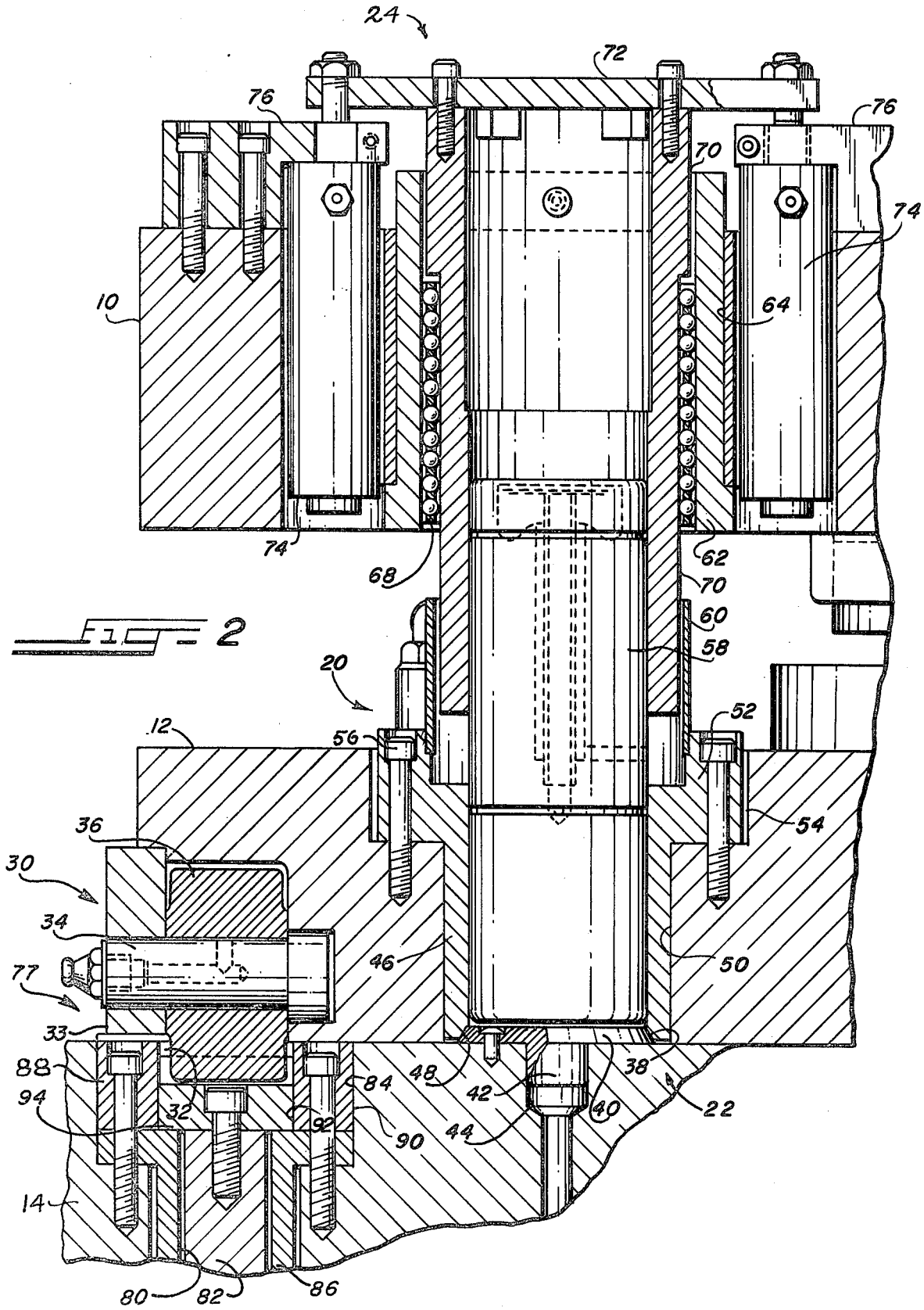
FIG. 2 is a fragmented vertical cross-section through the position-coordinating means between the die shoe and the blanking punch holder plate and the roll-off/roll-on means for the die shoe in position for the cupping operation.

A die shoe 12 mounts on top of the bed 14 of the press having a plurality of die sets 16 erected in staggered transverse array on its top surface for multiple cupping operation of the press. Each die set thereon comprises blanking and draw dies 18 which mount in the top of said die shoe. These dies are held in concentric relation with a blanking punch which is mounted on the blanking punch holder plate 10 by a position coordinating means 20 comprising a piloting means 22 and a guide means 24 which mount on and between the bottom of the blanking punch holder plate on the outer slide of the press and the bed of the same. A draw punch 26 which depends from the draw ram adapter plate concentrically cooperates with the draw die. The die shoe 12 includes a plurality of roller means 30 which are mounted in each corner of the shoe 12 and arranged for roll-on/roll-off of the shoe from the press bed on steel tracks 32 which extend the width of the bed in the direction of the flow of feed stock across the press during the operation of the same. Each roller means 30, as shown in FIG. 2, comprises an axle support 33 which depends from the side of the die shoe 12 and an axle 34 which is straddle-mounted on one end in the die shoe 12 and at its other end in the support 33. A hardened steel roller 36 rotationally mounts on said axle 34 between said support 33 and said die shoe 12.

Pilot means 22 between the die shoe and the bed of the press are lift-disengageable. Each pilot means 22 has a male surface 38, which mounts on the press bed under a corner of the die shoe adjacent to the roller means 30. Each pilot surface 38 has a concentric, circular, hardened steel base 40 bolted to and mounted on the top surface of the press bed. A stud pilot 42 depends from said pilot base 40 in concentric relation therewith and extends into bottomed cylindrical bore 44 in the top surface of said press bed for coordinating the position of each pilot means 22 in relation to the press.

Figure 3:
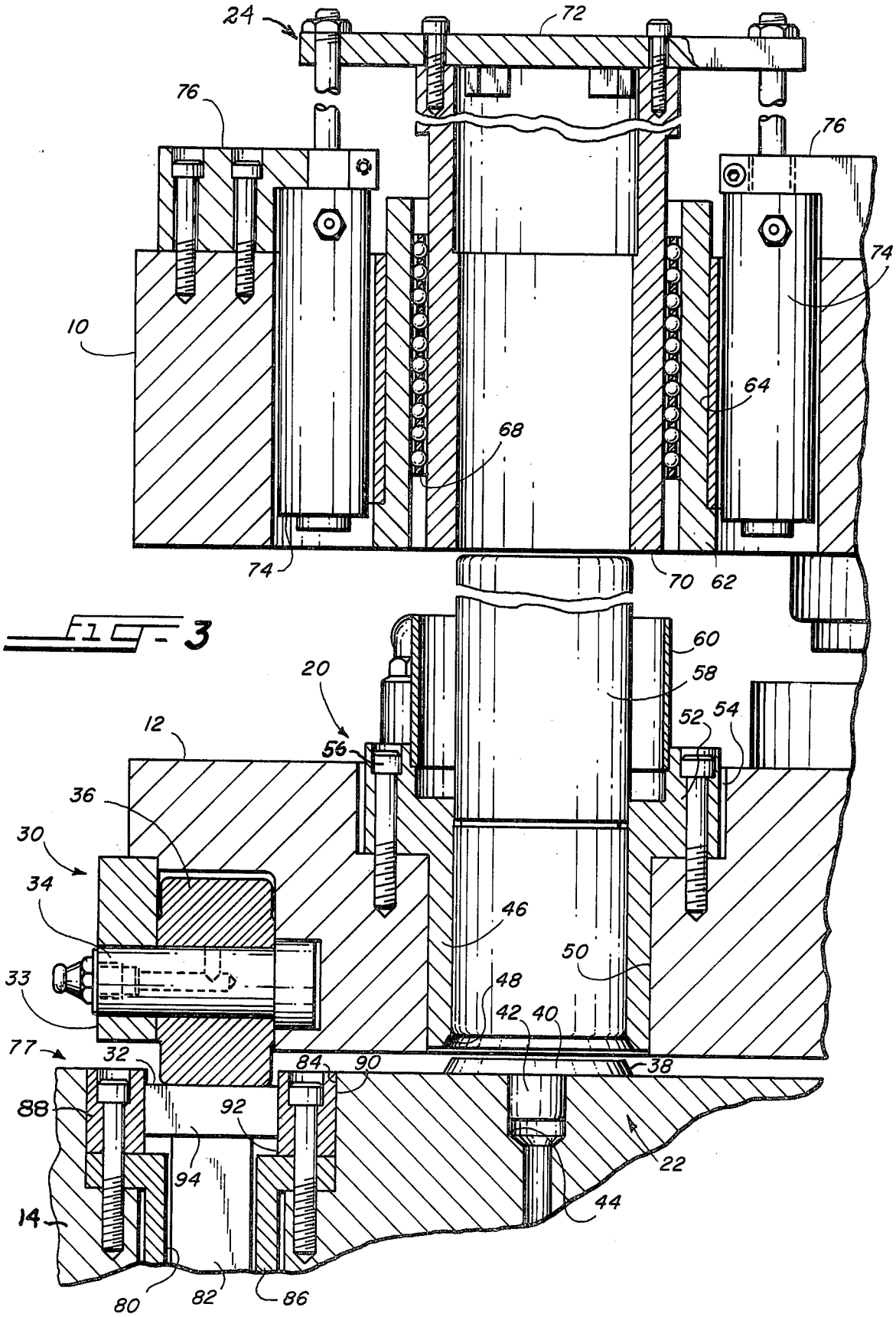
FIG. 3 is a similar fragmented cross-section as shown in FIG. 2 but in position for the roll-off/roll-on transfer of the die shoe.

A lift-disengageable piloting means 77 comprises four single-acting oil-hydraulic jacks 78 which face-mount the rod ends of their cylinders on the bottom side of the bed of the press, as shown in FIG. 1, one for each roller means 30 in the die shoe, as shown in FIGS. 2 and 3. Each jack 78 has its rod operationally extending upwardly through cylindrical bores 80 in the bed of the press on axes intersecting the axes of said roller axes 34 at right angles thereto. Lower ends of knuckle-rod extensions 82 mount on top of ends of rods on jacks 78, as shown in FIGS. 1, 2 and 3. Counterbores 84 extend down into top surface of the press bed in concentric relation to bores 80. Flanged sleeves 86 insert and bolt into said cylindrical bores 80 and bottom on said counterbores 84 around rods of jacks 78 and their knuckle-rod extensions 82. End frame inserts 88 having cylindrical outside diameters 90 and square bores 92 mount on top of flanged sleeves 86 on the ends of the rods of jacks 78. Square lift pads 94 mount on the upper ends of knuckle-rod extensions 82 in vertical sliding relationship with the square bores 92 in end frame inserts 88. Top surfaces of lift pads 94 clear the outer diameter of roller means 30 when rod ends of jacks 78 are in lowered position and raise the same to a level with the bottom of tracks 32 when the rods are in raised position thereby lifting the die shoe off the press bed and disengaging the female pilot member 48 on the die shoe from the male pilot member 38 on the bed for roll-on/roll-off transfer of the shoe from the same.

Guide means 24 between the blanking punch holder plate and the die shoe are retraction-disengageable. The guide means 24 mount between the blanking punch holder plate and the die shoe above in concentric relation with the pilot means 22, and comprise a flanged cylindrical guide bushing 46, having a female conical surface 48 for engaging the male conical surface 38 of the pilot means 22. Bushing 46 shrink-fit mounts in a cylindrical bore 50 in the die shoe 12 and has its flange 52 inserted in and bolted to the bottom of a counterbore 54 in the top surface of the die shoe adjacent to each roller means 30. Bolts 56 secure flange-mounted guide bushing 46 to the die shoe. Cylindrical leader pins 58 press-fit in the cylindrical bores of guide bushings 34 in the die shoe. The lead ends of pins 58 extend above the top surface of the die shoe in concentric relation with the piloting means 22 thereon. Shield members 60 having internal diameters which are larger than the diameter of the lead ends of pins 58 mount on the top side of flange-mounted guide bushing 46 and extend upwardly therefrom around and in concentric relation with said pins 58. Shouldered cylindrical guide bushings 62 shrink-fit into cylindrical bores 64 extending through the blanking punch holder plate in concentric relation with the piloting means 22 on the die shoe. Linear anti-friction bearings 68 mount in the bores of the guide bushings 62. Cylindrical guide sleeves 70 mount in the internal diameter of the bearings 68 for linear relative translation in the same direction and extend their lead ends below the bottom surface of the blanking punch holder plate while their top ends extend above the top surface of the same in concentric relation with the piloting means 22 on the die shoe and in sliding and piloting cooperation with the lead ends of the pins 58 extending above the top surface of the die shoe. Crossarms 72 mount in transverse relation to the vertical on the top ends of the guide sleeves 70. Double-acting pneumatic cylinders 74 mount in the brackets 76 secured to the top surface of the blanking punch holder plate astride the guide bushings 62 having their rod ends operationally connected to the opposite ends of crossarms 72.

In the operation of the quick change of heavy die sets on presses having a bed 14 and an interchangeable die shoe 12 mounted on said bed, the guide means between the blanking punch holder plate, tooling mounted thereon and the die shoe are first disengaged by actuation of the pneumatic cylinders 74, as shown in FIG. 3; the piloting means between the die shoe and the bed of the press are next disengaged by actuation of the oil-hydraulic jacks 78 whereby the die shoe is lifted by the lift-disengageable pilot means 77 from the press bed; the die shoe is then transferred from the bed of the press on the roller means 30 for repair or replacement of the tooling in the die set. Upon repair of the die shoe tooling, the die shoe is returned to the bed of the press on the roller means 30 and the die shoe is then lowered onto the press bed by the oil-hydraulic jacks 78 and pads 94 to position on engageable pilot means 77, as shown in FIG. 2. The pilot means 77 between the die shoe and the bed of the press are engaged by the deactuation of single-acting jacks 78, and the guiding means between the blanking punch holder plate and the die shoe are then engaged by the actuation of the pneumatic cylinders 74.

Figure 4:
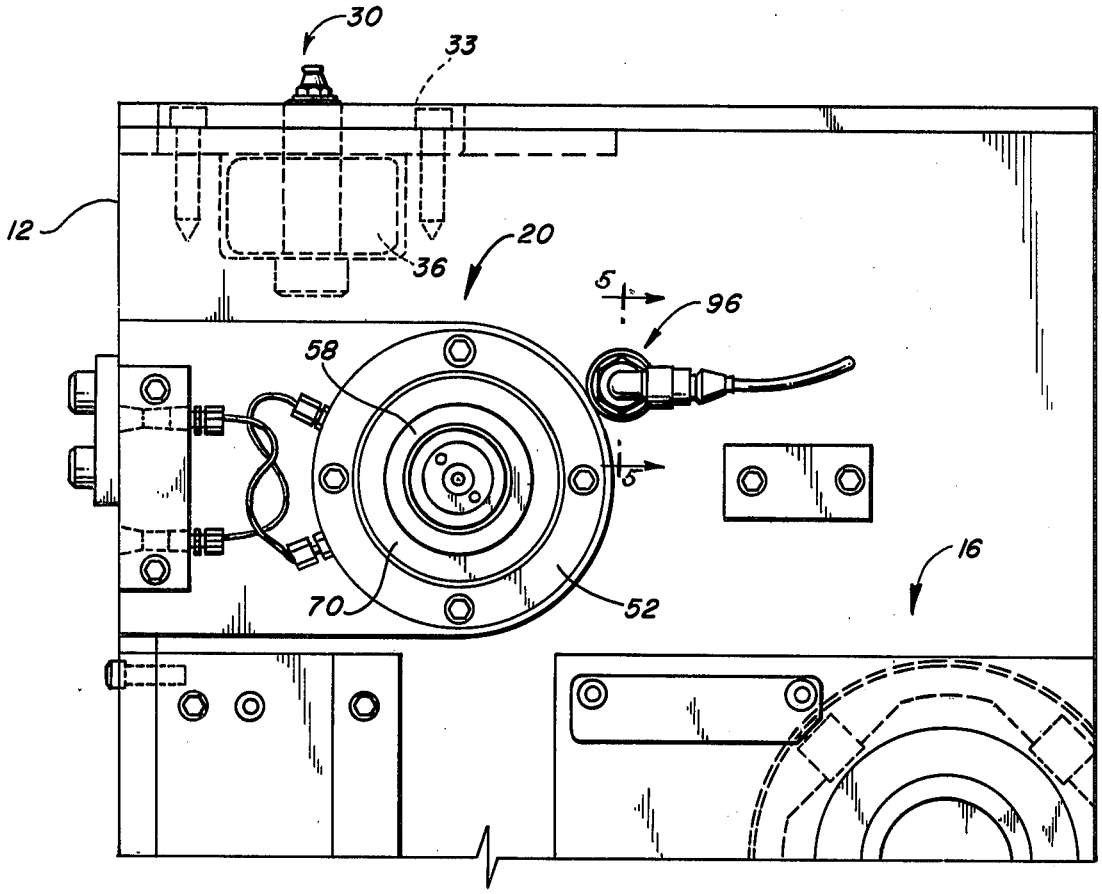
FIG. 4 is a fragmented plan view of the position-coordinating means on the die shoe.
Figure 5:
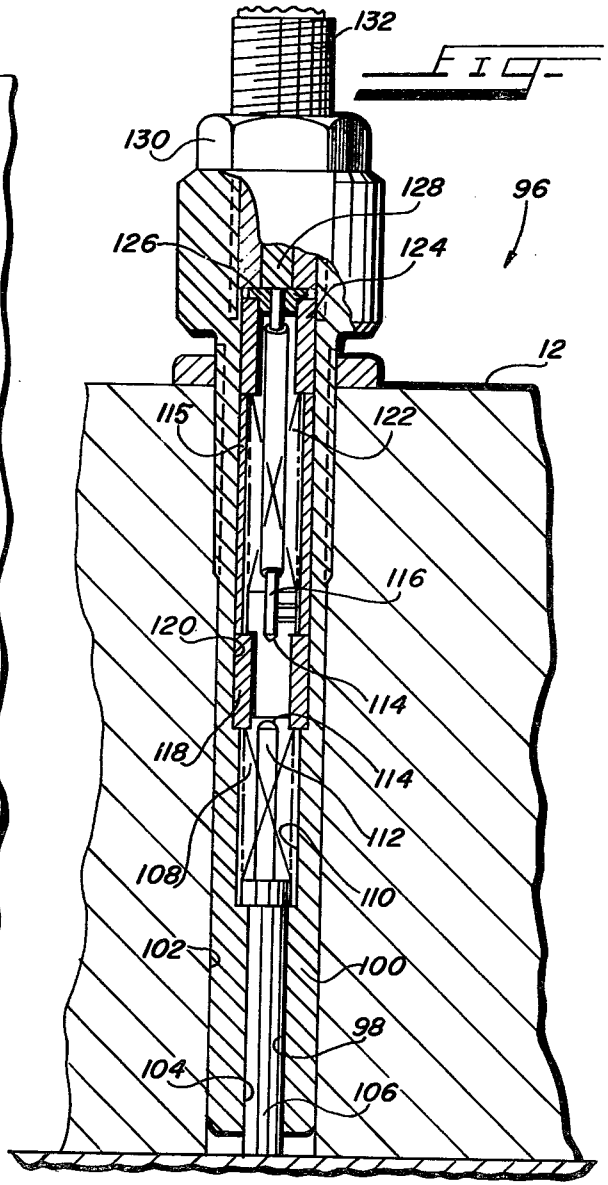
FIG. 5 is a fragmented cross-section along line 5—5 of FIG. 4.

Die shoe seating coordinating sensor means 96 is mounted in each corner of the die shoe adjacent to the guide means 24, as shown in FIGS. 1 and 4, and extends through and out the bottom surface of the die shoe 12 for sensing if the die shoe is fully seated on the bed, as shown in FIG. 5. Sensor means 96 comprises a stepped inner bore 98 in a sleeve 100 which is inserted in a second bore 102 in the die shoe extending from the top surface of the same to the bottom surface thereof and in threaded engagement therewith part way down in the largest top bore of the stepped bore 98. A contact pin 106 is slidably engaged in a smallest bottom bore 104 of the sleeve 100; a lower compression spring 108 is inserted in a slightly larger bore 110 adjacent and above said bottom bore 104 in bearing on the top of pin 106 for urging said pin 106 against the top surface of the bed; and a lower insulated electrode 112 is axially mounted in the spring 108 on the top end of said pin 106 having the lower electrical point of a normally-open make/-break switch 114 at the bottom of the same. A lower short sleeve 118 in a next larger bore 120 is mounted on the top of said lower compression spring 108; an upper compression spring 122 is inserted in the bore 120 mounted on the top of the short sleeve 118; a long sleeve 115 is mounted on the top of the short sleeve 118 in bore 120 surrounding said upper spring 122; an upper electrical point of the make/break switch 114 mounts on the bottom of an upper insulated electrode 116 in coaxial alignment with said lower portion thereof and mounted on said long sleeve 115; and an upper short sleeve 124 is mounted in bore 120 having an insulated plug 126 mounted in the top of short sleeve 124. A standard electrical connector 132 threadedly engages the knurled top of sleeve 100 and bears on the top of plug 126. An insulated electrode support 128 centrally mounts in the lower portion of connector 132. A jambnut 130 threadedly engages the threaded section of electrical connector 132.

Figure 6:
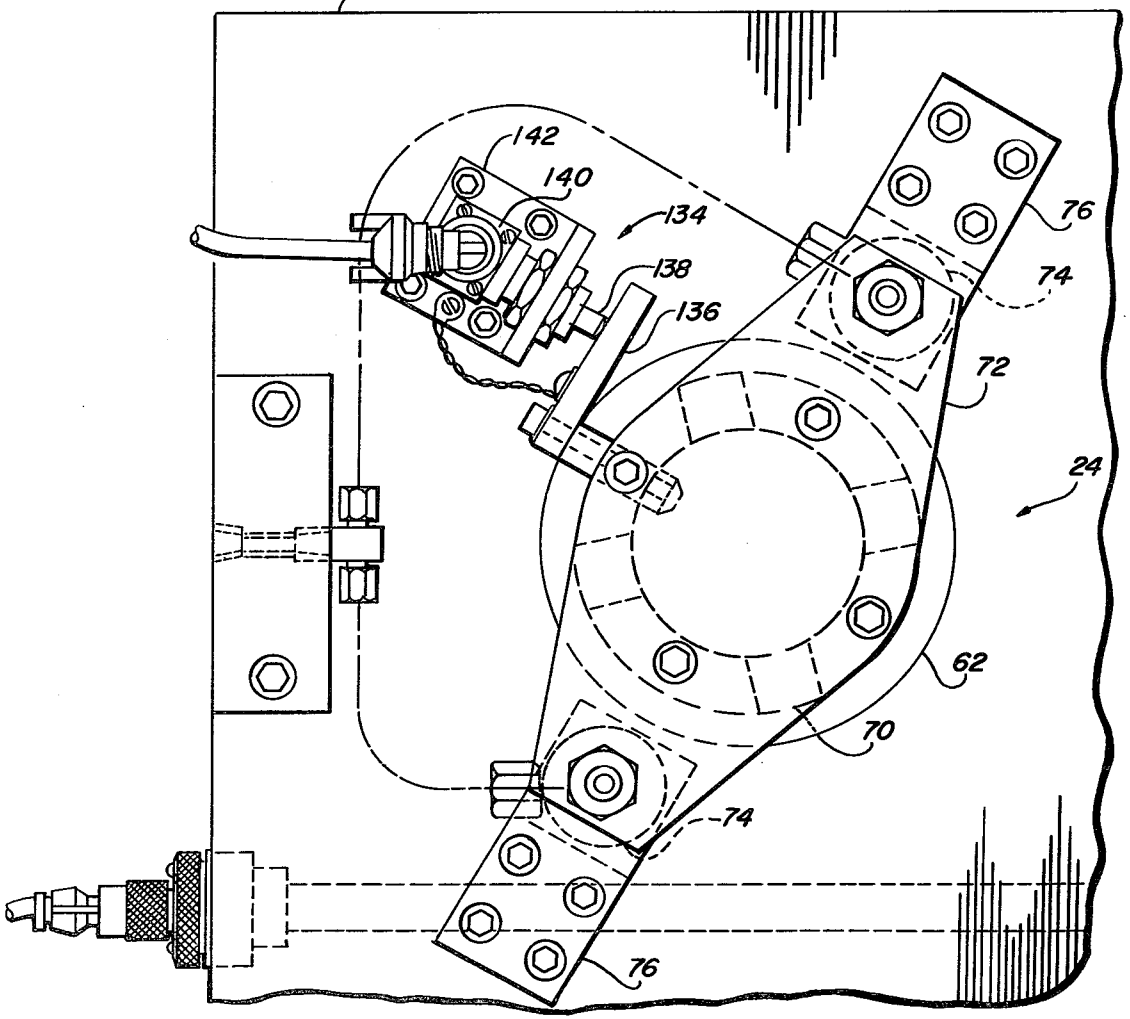
FIG. 6 is a fragmented plan view of the position-coordinating means on the blanking punch holder plate.

Alignment coordinating sensor means 134 also mount in each corner of the blanking punch holder plate 10 adjacent to the guide means 24 and spaced equally and anti-symmetrically angularly on each side of the staggered transverse array of die sets, as shown in FIG. 1. Each sensor means 134 operationally contacts a bar 136 mounted on and adjacent to the top of cylindrical guide sleeve 70, as shown in FIG. 6, having a surface thereon tangent to a circle centered on the guide sleeve 70, and arranged in anti-symmetrical angular array for sensing if the blanking punch holder plate 10 is aligned with the die shoe 12 for proper reciprocal action of the triple action die sets 16 erected on the die shoe 12 and the blanking punch holder plate 10, as shown in FIG. 2, during cupping operation of the press. Sensor means 134 comprises an angle iron bracket 142 having one leg bolted to the top surface of the blanking punch holder plate and its other leg extending upwardly parallel to the wall of guide sleeve 70. A normally open microswitch 140 mounts on the upwardly-extending leg having pushpin 138 operationally contacting the tangent surface on said bar 136 for closing the circuit containing switch 140 when the guide means 24 between the blanking punch holder plate and the die shoe are engaged.

Although but one specific embodiment of this invention is herein shown and described, it will be understood that details of the construction shown may be altered or omitted without departing from the spirit of the invention as defined by the following claims.

I claim:

1. An apparatus for quick changing of heavy die sets on presses having a bed, an outer slide supporting a blanking punch holder plate and an inner slide supporting a draw ram adapter plate, in combination, comprising:

(a) an interchangeable die shoe having lift-disengageable piloting means mounted between it and the bed of the press and retract-disengageable sliding guide means mounted between it and the blanking punch holder plate;

(b) means mounted between said die shoe and said blanking punch holder plate for engaging said guide means;

(c) means mounted between said bed and said die shoe for lifting and lowering said die shoe off said bed for disengagement and engagement of said piloting means; and (d) roller means mounted between said die shoe and said bed for rolling said die shoe off said bed when the die shoe has been lifted off said bed and the piloting means and guide means have been disengaged.

2. An apparatus as set forth in claim 1 wherein the lift-disengageable piloting means comprises mating disengageable surfaces; one of which is mounted on the top surface of the bed of the press and the other of which is mounted on the bottom surface of the die shoe in concentric relation one to the other.

3. An apparatus as set forth in claim 1 wherein the retract-disengageable sliding guide means comprises:

(a) a cylindrical leader pin mounted in the die shoe and extending upwardly from the top surface thereof;

(b) an enlarged cylindrical bore mounted in the blanking punch holder plate in concentric relation with said leader pin; and (c) a cylindrical sleeve slidingly mounted on said pin and extending upwardly within said bore in concentric relation therewith.

4. An apparatus as set forth in claim 1 wherein the means for engaging said guide means comprises:

(a) a linear anti-friction bearing rollingly-mounted between the outside of said cylindrical sleeve and the inside of said enlarged cylindrical bore;

(b) a crossarm mounted on top of said cylindrical sleeve extending laterally astride said sleeve above the top surface of said blanking punch holder plate; and (c) fluidic cylinder means mounting in the blanking punch holder plate having rod ends operationally connected to said crossarm.

5. An apparatus as set forth in claim 1 wherein the roller means comprises:

(a) axle-mounted rollers rotationally-depending from said die shoe; and (b) tracks in top surface of said press bed operationally-cooperating with said rollers.

6. An apparatus as set forth in claim 1 wherein the means for engaging said piloting means comprises fluid-hydraulic jack means mounting in the press bed having rod ends operationally connected to said roller means.

7. An apparatus for quick changing of heavy die sets on presses having a bed, an interchangeable die shoe having lift-disengageable piloting means mounted between it and the bed of the press, an outer slide supporting a blanking punch holder plate, an inner slide supporting a draw ram adapter plate and a roller means mounted between the die shoe and said bed for rolling said die shoe off said bed when the die shoe has been lifted off said bed, in combination, comprising:

(a) a retract-disengageable sliding guide means mounted between the die shoe and the blanking punch holder plate; and (b) means mounted between said die shoe and said blanking punch holder plate for engaging said guide means.

8. An apparatus as set forth in claim 7 wherein the retract-disengageable sliding guide means comprises:

(a) a cylindrical leader pin mounted in the die shoe and extending upwardly from the top surface thereof;

(b) an enlarged cylindrical bore mounted in the blanking punch holder plate in concentric relation with said leader pin; and (c) a cylindrical sleeve slidingly mounted on said pin and extending upwardly within said bore in concentric relation therewith.

9. An apparatus as set forth in claim 7 wherein the means for engaging said guide means comprises:

(a) a linear anti-friction bearing rollingly-mounted between the outside of said cylindrical sleeve and the inside of said enlarged cylindrical bore;

(b) a crossarm mounted on top of said cylindrical sleeve extending laterally astride said sleeve above the top surface of said blanking punch holder plate; and (c) fluidic cylinder means mounting in the blanking punch holder plate having rod ends operationally connected to said crossarm.

* * * * *